US007114877B2

(12) United States Patent
Wilkerson

(10) Patent No.: US 7,114,877 B2
(45) **Date of Patent: *Oct. 3, 2006**

(54) DRAINAGE SYSTEM FOR SPORTS FIELDS

(76) Inventor: Dennis James Wilkerson, 7210 Falling Oaks, Spring, TX (US) 77389

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 0 days.

(21) Appl. No.: 10/356,964

(22) Filed: Feb. 3, 2003

(65) Prior Publication Data

US 2003/0118403 A1 Jun. 26, 2003

Related U.S. Application Data

(63) Continuation-in-part of application No. 10/000,740, filed on Oct. 31, 2001, now abandoned.

(51) Int. Cl.
*A01G 25/06* (2006.01)
*E02B 11/00* (2006.01)

(52) U.S. Cl. ..... 405/43; 405/50; 405/36; 405/43; 47/65.5; 47/80; 52/302.7

(58) Field of Classification Search ..... 405/43, 405/50, 40, 45, 36, 46; 47/65.6, 80; 52/302.7
See application file for complete search history.

(56) References Cited

U.S. PATENT DOCUMENTS 725,793 A * 4/1903 Suddath ..... 137/236.1
1,129,324 A * 2/1915 Appelman ..... 405/45
1,405,725 A * 2/1922 Snively ..... 210/170
1,591,453 A * 7/1926 Heermans
1,866,826 A * 7/1932 Strothmann ..... 405/45
2,701,027 A * 2/1955 Scoville ..... 210/163
3,339,366 A * 9/1967 Gogan et al. ..... 405/36
3,625,011 A * 12/1971 Stevenson ..... 404/2
4,156,324 A * 5/1979 Henttonen ..... 47/48.5
4,268,993 A * 5/1981 Cunningham ..... 405/37
4,345,998 A * 8/1982 Graffis et al. ..... 210/164
4,457,646 A * 7/1984 Laesch ..... 405/36
4,572,700 A * 2/1986 Mantarro et al. ..... 404/35
4,576,511 A * 3/1986 Vidal, Jr. ..... 405/37
4,756,643 A * 7/1988 Hurley ..... 405/43
4,832,526 A * 5/1989 Funkhouser, Jr. ..... 405/36
4,960,345 A * 10/1990 Hurley et al. ..... 405/258.1
4,983,069 A * 1/1991 Florence ..... 405/36
4,988,235 A * 1/1991 Hurley ..... 210/164
5,064,308 A * 11/1991 Almond et al. ..... 405/36
5,161,912 A * 11/1992 Schlueter et al. ..... 137/875
5,195,284 A * 3/1993 Florence ..... 52/169.5
5,197,824 A * 3/1993 Paurat et al. ..... 405/129.7
5,316,410 A * 5/1994 Blume ..... 405/45
5,375,940 A * 12/1994 Kobayashi ..... 404/2
5,466,091 A * 11/1995 Sauerwein et al. ..... 405/118

(Continued)

*Primary Examiner*—Katherine Mitchell
(74) *Attorney, Agent, or Firm*—William D. Durkee; Howrey LLP

(57) ABSTRACT

An improved system for draining bunkers on golf courses and other sports playing areas, and for draining landscaped areas. A receptacle is positioned below the surface for receiving drain water and for discharging the water through an outlet. A perforated pipe water collection system can be attached to the receptacle to direct water to the receptacle interior space. A receptacle cover is removable to permit access to the receptacle interior space. The cover is sufficiently strong to support the overlying weight of people and equipment, and can have apertures for permitting water entry while resisting entry of sand and other solids into the interior space of the receptacle.

23 Claims, 8 Drawing Sheets

U.S. PATENT DOCUMENTS 5,688,073 A * 11/1997 Brodeur et al. ..... 405/36
5,791,098 A * 8/1998 Thomas ..... 52/169.6
5,810,510 A * 9/1998 Urriola ..... 137/236.1
5,848,856 A * 12/1998 Bohnhoff ..... 405/36
5,895,569 A * 4/1999 Connelly ..... 210/170
6,062,767 A * 5/2000 Kizhnerman et al. ..... 210/170
6,095,718 A * 8/2000 Bohnhoff ..... 405/52
6,142,703 A * 11/2000 Wilmot et al. ..... 239/145
6,161,776 A * 12/2000 Byles ..... 239/145
6,419,421 B1 * 7/2002 Whitfield, Jr. ..... 405/36

* cited by examiner

DRAINAGE SYSTEM FOR SPORTS FIELDS

CLAIM TO PRIORITY

This application is a continuation-in-part of application Ser. No. 10/000,740 filed Oct. 31, 2001.

BACKGROUND OF THE INVENTION

The invention relates to under-surface drain systems and particularly systems for bunkers in golf courses, drainage areas in sports fields, such as the areas along the sides of tennis courts, and football, baseball, and soccer fields; and landscape areas where under-surface drainage systems are required or preferred for consistent surface appearance and integrity.

A golf course imposes unique design requirements on turf systems and sand bunkers on the course. Bunkers are deliberately positioned to create artificial hazards for errant golf balls The bunkers are typically constructed as depressions having a clay base with sloped sidewalls rising upward to surrounding turf. The bunkers have specific peripheral configurations, depth, and sloped sides. Sand overlays the clay base or other base material to provide the playing surface for golf balls. The sand is typically groomed daily by hand or with motorized equipment to present an even surface to the golfers. Rakes and other equipment fluff the top surface of the sand to present the desired surface. A drainage system for bunkers should be located below the surface of the sand a sufficient distance to allow regular sand shots to be taken above the drainage system.

In wet climates, rainwater compacts the sand and mixes the sand with the underlying clay base. Clay particles or "fines" discolor the overlying sand and also alter the playing qualities of the bunker. Various efforts have been made to reduce the commingling of sand and clay particles and to prevent other contamination of the sand. As shown in U.S. Pat. No. 5,746,546 to Hubbs et al. (1998), fiber strands and water absorbent particles such as psyllium may be added to soil to improve the soil shear strength.

Other bunker systems use geotextile fabrics underlying the sand. Fabric liners do not easily retain the sand on the sloped sides and are subject to rupture and other failure. Such liners do not independently correct the problems associated with accumulation of rainwater in the bunkers.

Because the bunkers comprise depressions in the soil, rainwater collects in the bunkers and must be drained to another location. Perforated pipe has been installed in the bottom of bunkers to drain excess water to a water discharge line. Gravel has been packed around the exterior surface of the perforated drain pipe to form a French drain. Such systems eventually fail in wet climates because the clay linings are susceptible to erosion. Clay particles and other contaminants such as grass clippings pack around the perforated pipe to lower the fluid transmissivity of the gravel, and such particles further enter the pipe interior. Over time the accumulated intrusion clogs the pipe which requires new construction of the entire bunker. Such construction is not only expensive to accomplish but also disrupts the utility of the golf course during construction.

Landscape areas whether mulched; sand and stone; grass of various types; and flowerbeds should have unique under-surface design to preclude standing water in low areas. Standing water in low areas contributes to damage of living plants in landscaped areas and leaves residual flotsam, debris and watermarks which destroy and compromise the surface design and appearance.

Drain systems have been developed for other applications such as large playing fields. For example, U.S. Pat. No. 5,648,856 to Bohnhoff (1998) discloses a thermoplastic mat underlying the surface which facilitates capture of water within an inflatable container for redistribution to the turf surface. Bohnhoff further describes conventional perforated pipe networks and the problems associated with poor drainage. Large playing fields usually require drainage along the sides of the fields. The fields are usually rounded to drain toward the sides. These fields need a drainage system which is below the playing surface to avoid interference with the play of the game and support activities around the fields.

In bunkers having perforated pipe drains, clay fines inevitably pack off the pipe at the lowest point in the bunker. This occurrence causes excess water to pond at this position within the bunker, further accelerating deterioration of the bunker drainage system. A need exists for an improved bunker drainage system which facilitates water drainage from bunkers and facilitates maintenance operations, and for a water drainage system for other sports fields which can be located below the sports surface to avoid interference with play and field use above the drainage system.

SUMMARY OF THE INVENTION

The invention provides a system for draining water from a bunker having a surface covered with sand, from a different sports field having a playing surface above the drainage system, or from other types of landscaped areas. The system comprises a receptacle or box having an interior space for collecting water and for discharging the water through an outlet in the receptacle, wherein the receptacle is capable of being positioned below the bunker surface or sports field at an elevation below the sand or usable sports surface. An aperture may be located in the receptacle for permitting water entry into the receptacle's interior space, such as from a perforated piping system, and a water permeable cover is located over the receptacle to resist entry of sand or other surface material into the receptacle's interior space. The cover is preferably detachable and/or moveable to permit entry into the interior space of the receptacle for cleaning.

In another embodiment of the invention, a pipe or piping system is connected to the receptacle to collect water and direct water toward the receptacle. The pipe or piping system may or may not be perforated and can be divided into a water collection system having two or more branches for covering a larger surface, such as the area of a bunker or the sides of a playing field.

DESCRIPTION OF THE PREFERRED EMBODIMENTS

Figure 1:
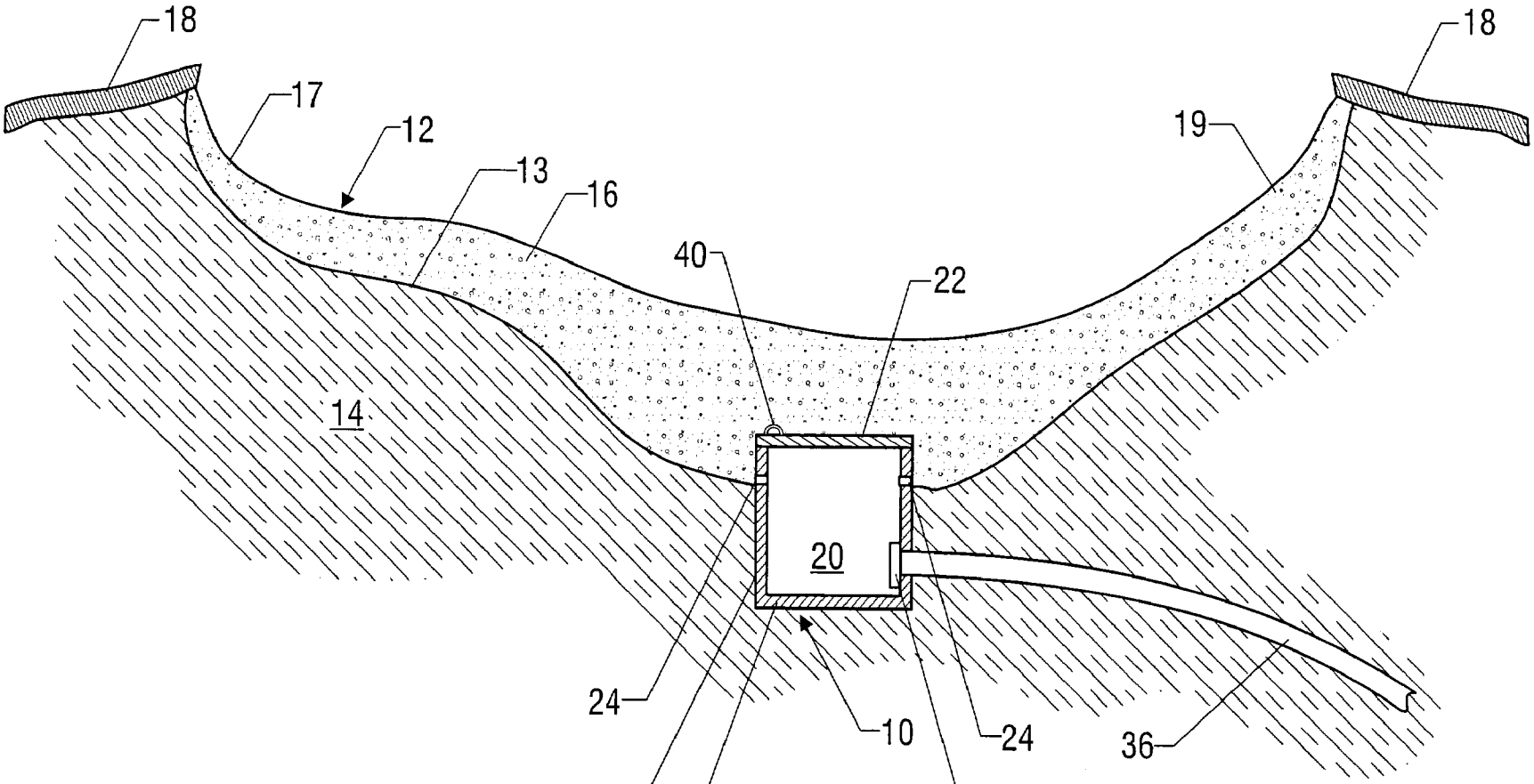
FIG. 1 illustrates a sectional view in elevation of a drain system installed in a bunker.

The invention provides a method and apparatus for draining water from a bunker or other sports field having a surface covered with sand or other playable or usable sports surface. The invention is also applicable to drainage of landscaped areas. FIG. 1 illustrates receptacle or box 10 positioned within bunker 12 which comprises soil 14 and sand 16. Bunker 12 is irregularly shaped and is sloped toward one or more ends so that excess water collects toward the low end of bunker 12. Soil 14 can comprise existing soil, imported material such as clay, stabilized soil material, or other conventional bunker or sports base material. Bunker 12 has sloped sides 17 and 19 which terminate at the ground elevation of turf 18 so that bunker 12 forms a golf playing hazard below the ground elevation of turf 18.

Figure 2:
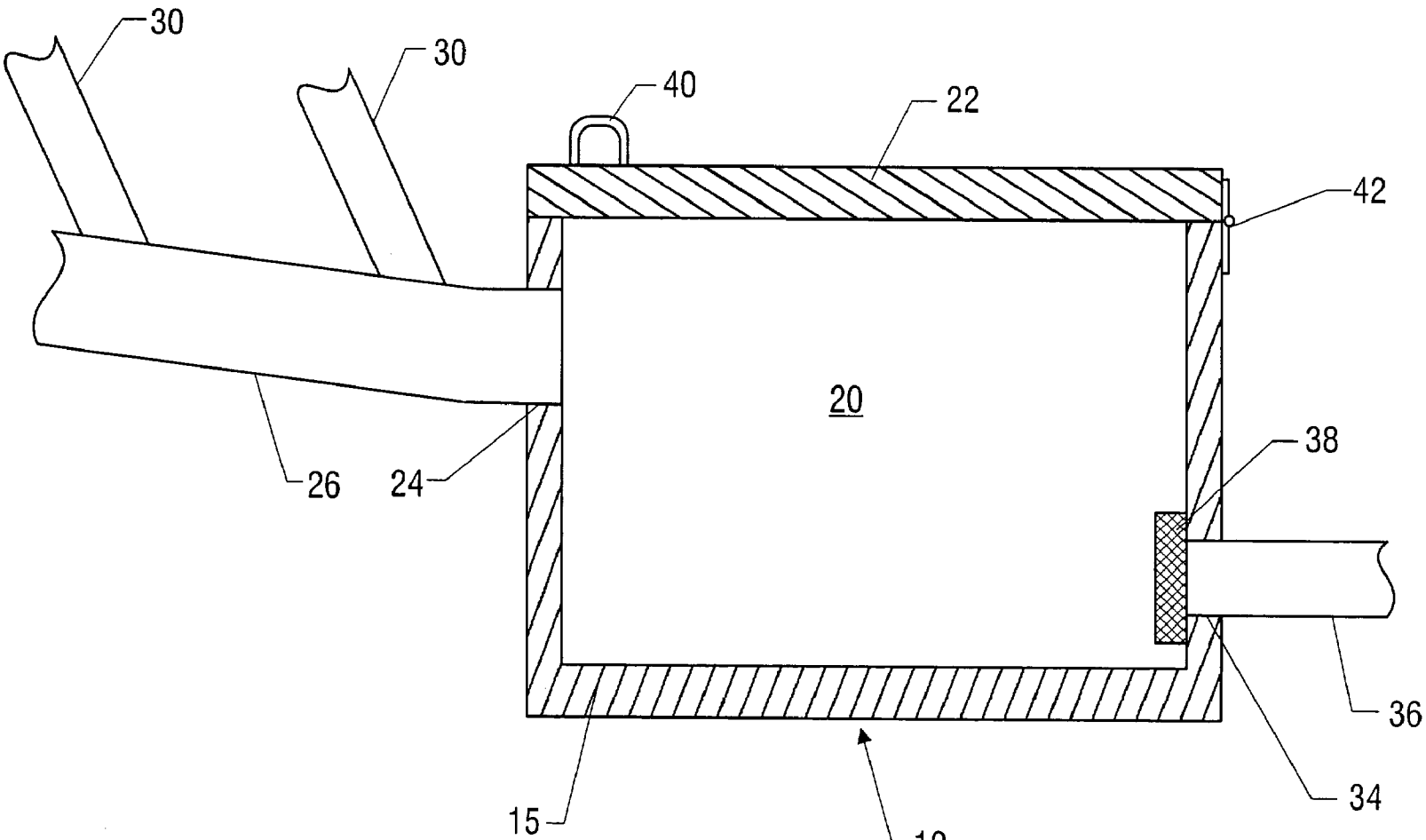
FIG. 2 illustrates a sectional view in elevation of an inlet pipe connected to the drain system illustrated in FIG. 1.
Figure 3:
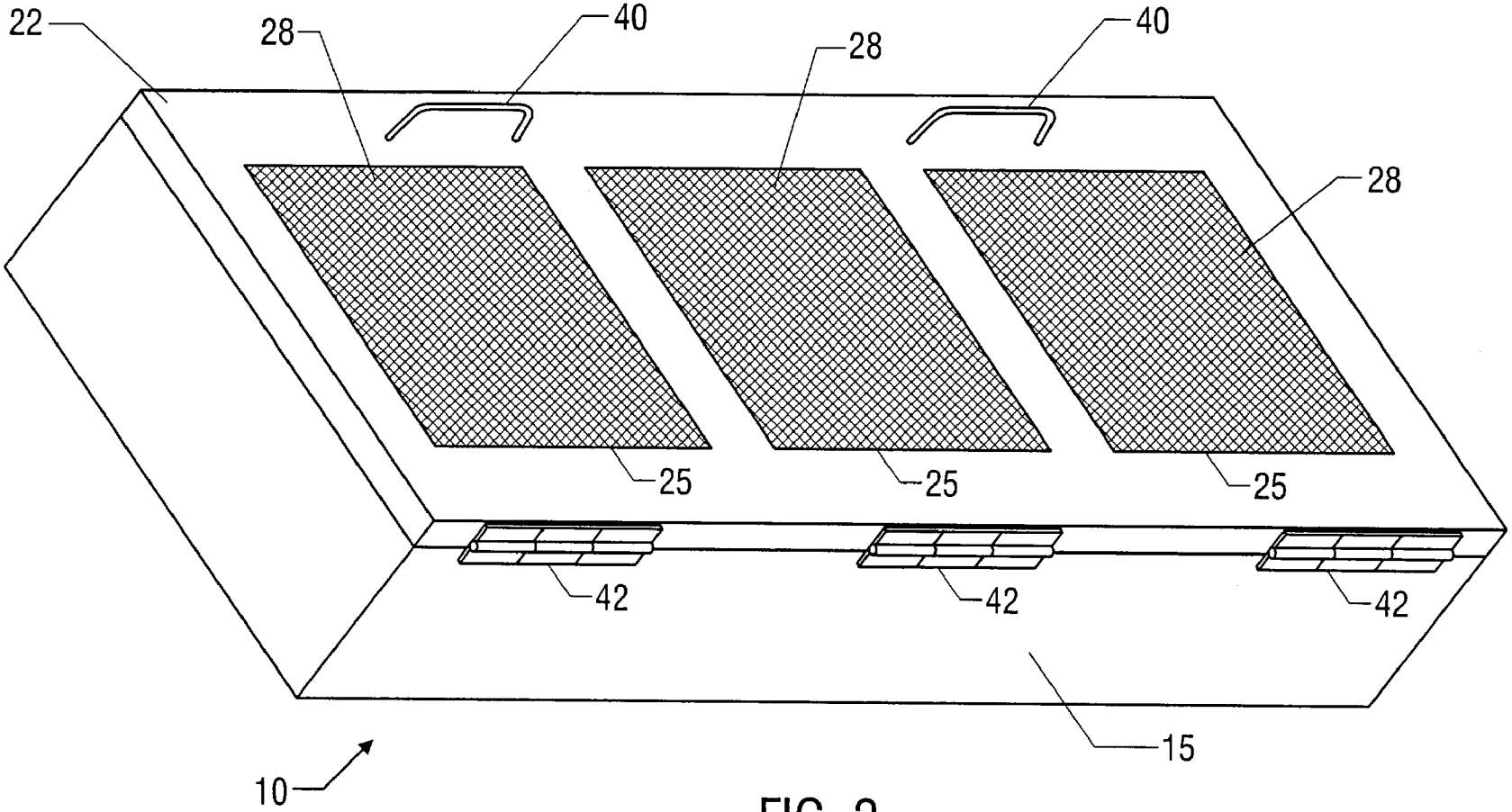
FIG. 3 is a perspective view of the drain box of FIGS. 1 and 2 for permitting entry of water while resisting entry of solids into the interior space of the drain box.

Receptacle or box 10 comprises a substantially hollow bucket, basin, container, or vessel 15 having interior space 20 and is formed with a material resistant to degradation such as plastic or aluminum. Cover 22 is engaged with container 15 to cover the top opening of container 15 and is movable to permit entry into interior space 20. Cover 22 is designed to resist entry of sand and other solids into interior space 20 and can be positioned over the upper portion of container 15 to form the receptacle or box 10. One or more apertures 24 may be located in container 15, cover 22, or both to permit water entry into interior space 20. As shown in FIG. 3, one or more mesh apertures 25 can be incorporated in cover 22 to permit water entry. As shown in FIG. 2, aperture 24 can be connected to water inlet pipe 26 for the purposes described below.

Apertures 25 preferably contain a mesh or screen 28 which has openings or mesh size smaller than the predominant particle sizes of sand 16 and other solids present, except for small fines, to resist or minimize entry of them into interior space 20. Screen 28 can be integrated within apertures 25, and apertures 25 can be of one or many sizes to provide the function of resisting and minimizing sand entry as shown in FIG. 3. Screen 28 can be formed with a rigid or flexible material resistant to degradation and can comprise metal, plastic, composites, fiberglass, filter cloth, or other material. Screen 28 can be removable to facilitate damage repairs or to adjust the mesh size of screen 28.

With reference to FIG. 2, aperture 24 can be positioned in a side of receptacle 10 for connection with water inlet pipe 26. Pipe 26 can comprise a perforated pipe having one or multiple branches 30, preferably made of perforated pipe, for installation in different portions of bunker 12 to facilitate drainage. The perforated pipe preferably has perforations of a size to resist or minimize entry of sand or other solids into the pipe.

Figure 4:
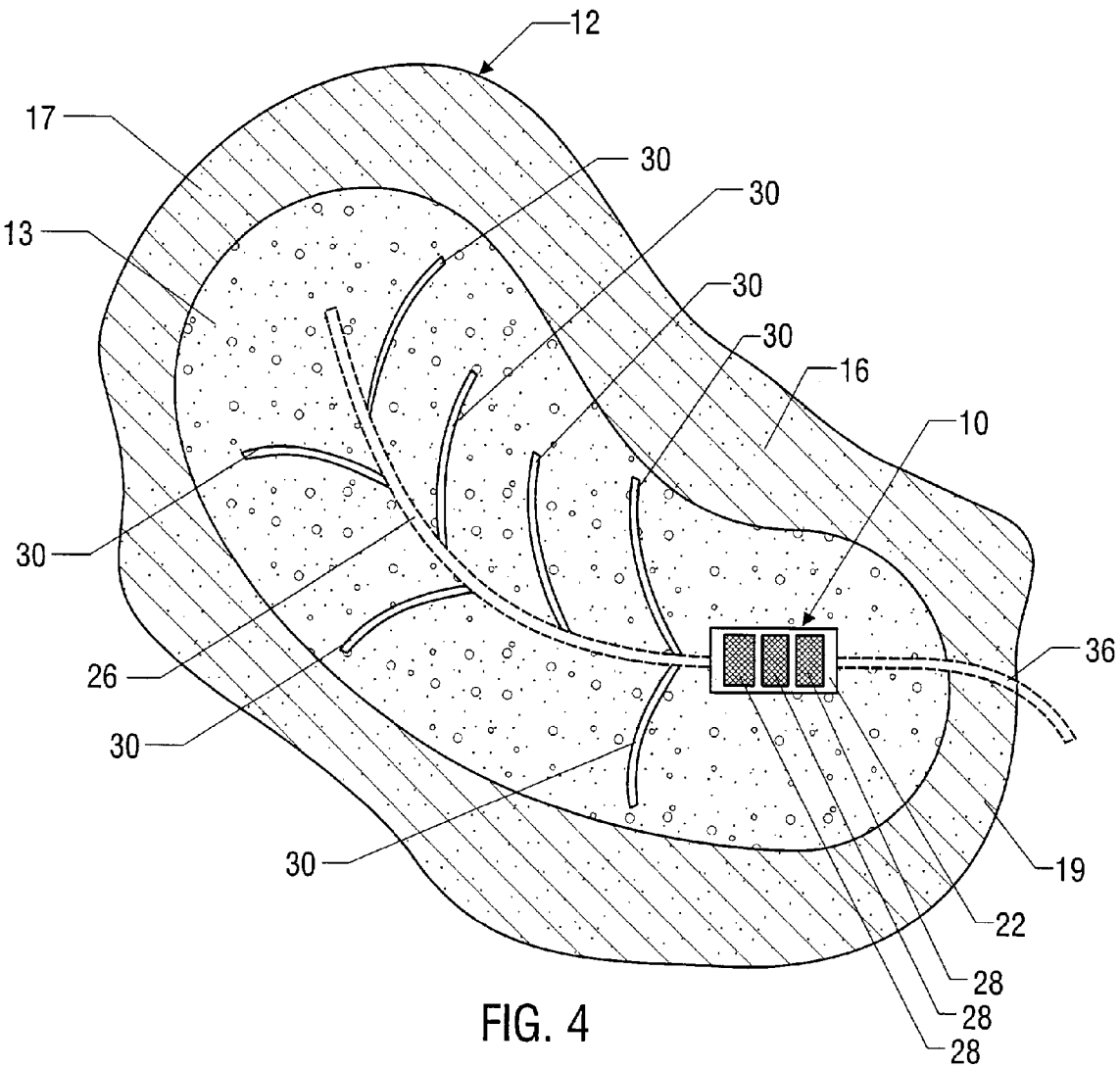
FIG. 4 illustrates a plan view of a perforated pipe collection system draining water to a drain box and a water outlet from the drain box, the sand above the drainage system being removed.
Figure 5A:
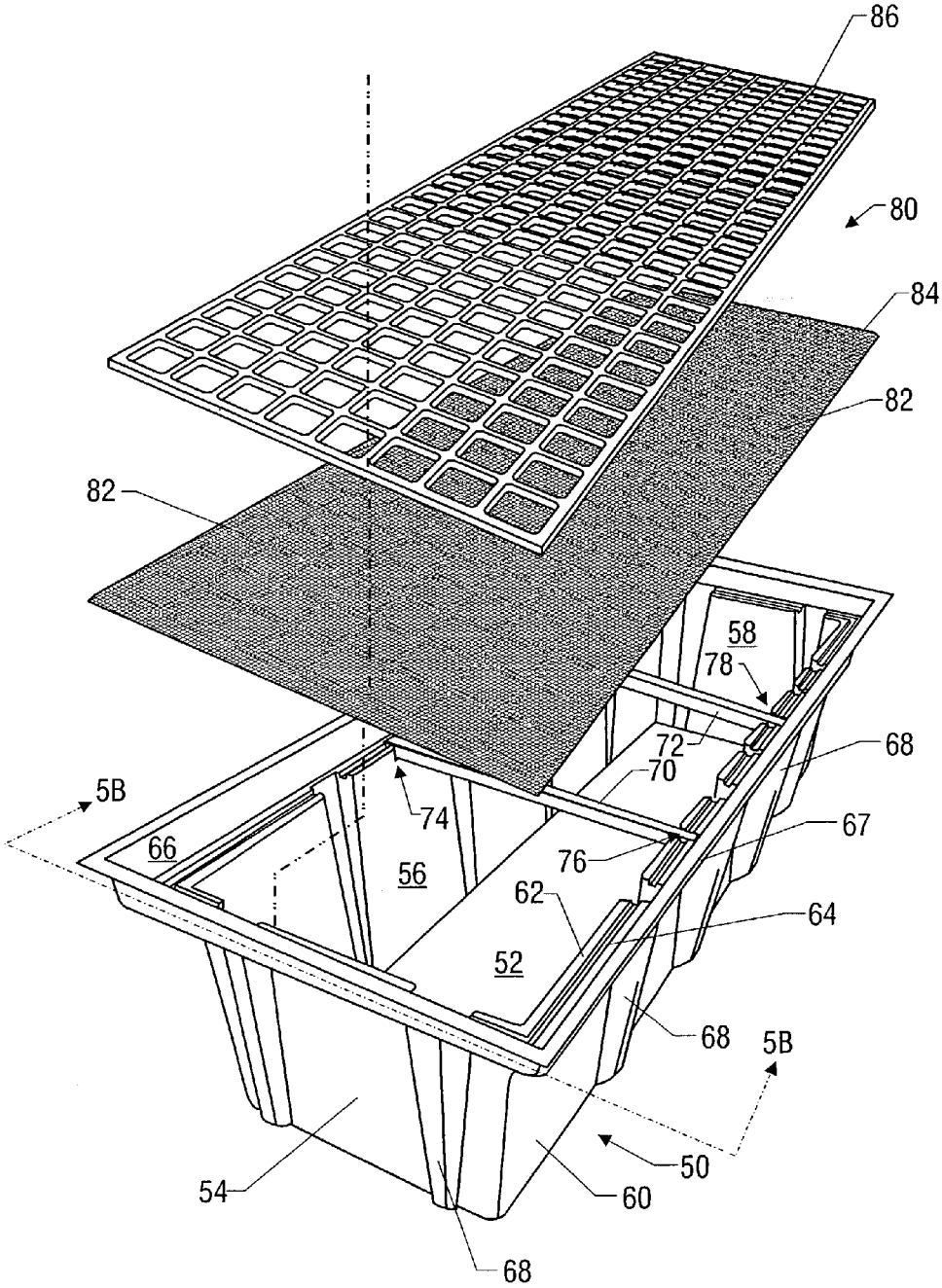
FIG. 5A is an exploded view of a drain box in accordance with the invention.
Figure 5B:
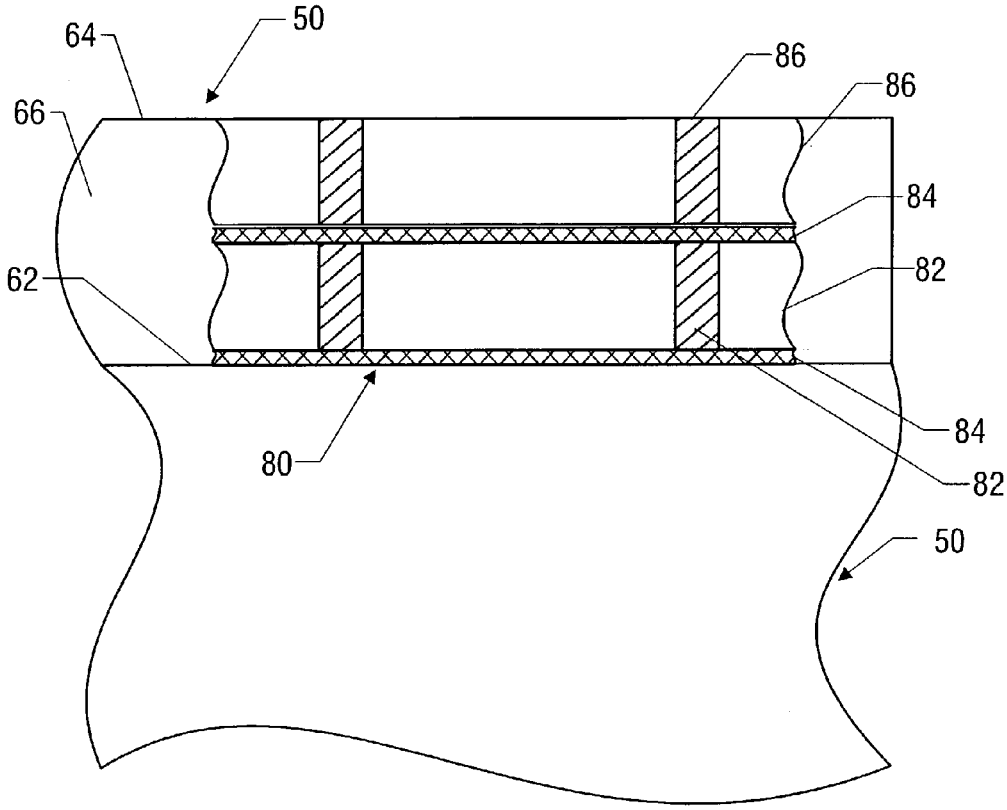
FIG. 5B is a partial sectional view of the drain box in FIG. 5A taken along the line 5B—5B.

FIG. 4 illustrates a plan view of sand bunker 12 (with sand above the drainage system removed) wherein multiple branches 30 of perforated pipe 26 are positioned in bunker 12 to resist surface movement of water and to facilitate water drainage from above the bottom surface 13 of bunker 12. One or more pipes 30 can connect directly to receptacle 10 or such pipes can be branches and joined with a single trunk pipe 26 connected to receptacle 10 as shown. Trunk pipe 26 may be perforated or non-perforated. Depending upon the configuration and various elevations of bunker 12, more than one receptacle 10 can be installed at various low points within bunker 12, and such receptacles 10 can be connected together with a pipe or each can separately drain to an outside location. Although pipe 26 is not essential to the operation of the invention, pipe 26 removes water from the surface of bunker 12 at different locations and reduces the horizontal migration of water within bunker 12. This feature reduces the impact of erosion on sand 16 during moderate rainfall. For events of heavy rain or watering, excess water can flow along the surface of bunker 12 and enter receptacle 10 through the cover 22.

Referring to FIG. 2, receptacle 10 has one or more water outlets 34 for discharging water from interior space 20. Outlet 34 can be connected to a conduit or pipe 36 for transporting water to another location, such as a pond, sewer, ditch, or grassy surface, by gravity fall or with a pump mechanism (not shown). Outlet 34 can be positioned flush with the bottom of interior space 20 or can be elevated above such bottom as illustrated to trap sediments within receptacle 10 for subsequent removal. If desired, filter 38 made of mesh or screen of suitable mesh size or openings can be positioned proximate to outlet 34 to restrict sediment particles from outflow into conduit 36.

As shown in FIG. 1, handle 40 may be attached to cover 22 to facilitate removal of cover 22 from engagement with container 15. In one embodiment of the invention, one or more hinges 42 (FIG. 3) can connect cover 22 to container 15. Cover 22 is located on the upper portion of container 15 and is preferably strong enough to withstand weight and impacts from persons or equipment or other animate or inanimate objects traveling over or stepping onto cover 22. By positioning sand or other playing surfaces over box 10 including cover 22, the presence and function of cover 22 is not readily apparent to golfers or other sports players, leading to relatively uninterrupted play. This feature of the invention is particularly significant because a golf ball resting above box 10, including cover 22, can be played from the surface of overlying sand 16 without interference, thereby providing uninterrupted play regardless of location.

The invention provides superior benefits regarding the installation cost, operability, and maintenance costs associated with sand bunkers on golf courses, other sports fields, landscaped areas, and other applications. A drain system in accordance with the invention can last longer than previous systems and can be serviced and flushed Costly replacement of perforated drain pipe systems is essentially eliminated, since cover 22 provides access to interior space 20 within receptacle 10 to facilitate routine sediment removal. Sediment is easily removed from interior space 20, from upstream pipe 26, and from downstream conduit 36. Pipe cleaning tools can be operated through cover 22 and moved upstream through pipe 26 or downstream through conduit 36 to remove sediments intruding into pipes 26 and 36 without requiring upstream location of entrances to pipe 26, and without requiring removal of pipe 26 from soil 14 or sand 16. Underground maintenance can be performed through box 10 after removal of cover 22 without significant interference of golf play, and without significant disruption of the sand surface of bunker 12. These features of the invention permit ongoing maintenance of golf bunkers and other playing surfaces without causing expensive cessation of play.

By providing cover 22 independent from container 15, the configuration of apertures 24 or the size and composition of screen 28 can be adjusted to adapt to field conditions, or to permit change in the composition of materials such as a change in the bunker sand 16. Screen 28 can comprise a single material or a composition of different materials or layers, and can include screen and embedded strength components.

To enter interior space 20, the position of receptacle 10 below the outside surface can be mapped regarding its location, and sand or overlying playing material 16 can be removed from the relatively small region overlying cover 22. After cover 22 is located, cover 22 can be completely detached from the receptacle, or otherwise moved relative to container 15 to permit entry into interior space 20 for inspection or maintenance. When finished, cover 22 is reinstalled relative to container 15 to form box 10, and sand 16 or other playing material is replaced over cover 22 to restore the playing surface.

It should be noted that the layer of overlying sand 16 or other playing material over the cover 22 also acts as a filter of particles tending to enter the drainage box 10. If desired, other filter material or filter aids may be placed on the cover 22 and/or associated perforated pipes to enhance filtration.

A preferred embodiment of the invention is illustrated in FIGS. 5A, 5B, 6, 7 and 8. As there shown, a bucket, container, basin, or vessel 50 is located at a low point of a sand trap 51 and has a generally rectangular shape with a bottom 52 and four side walls 54, 56, 58 and 60. The container 50 has a peripheral upwardly facing support surface or shelf 62, which has a horizontal reinforcement channel or groove 64 around its periphery. A vertical retaining rim or lip 66 extends around the periphery of the container 50 around the periphery of the shelf 62. A substantially horizontal edge 67 extends outwardly around the rim 66 to increase the strength of the container 50.

The container 50 should have an appropriate size and shape for a particular location of use. A container about 12 inches high, 16 inches wide, and 48 inches long has been found to be acceptable for most normal sand traps. A round, square, or triangular container may also be employed in particular situations, but a rectangular container is preferred for ease of use and construction and a minimum of expense.

The container 50 preferably has strengtheners or vertical channels 68 molded in walls 54, 56, 58 and 60 and spaced around the periphery of the container 50 to increase the strength of the container 50. Cross supports 70 and 72 may fit into support holders 74 and 76 in opposite sides of the shelf 62 along with holder 78 and a corresponding holder (not shown) to add strength to the container 50. The supports 70 and 72 may be metal or composite rods or other strong materials which resist bending, and are preferably removeable to facilitate entry into and cleaning of box 50. Rebar, aluminum rods or bars, fiberglass rods or bars, etc., may be employed depending on the circumstances.

A cover 80 fits on and over the top of container 50 and rests on and is supported by shelf 62. The cover 80 preferably comprises a supportive grate or grid 82 which is covered by a water permeable bag, sock, or envelope 84 which envelopes the grid 82 like a pillow case. A protective grate or grid 86 fits over and on the bag 84 to form a structural cover 80 which has acceptable strength to accommodate players and equipment above the cover 80. Alternatively, one or more layer of water permeable material can be placed between grate 82 and grate 86, but the bag or sock 84 is preferred for strength, for keeping the parts in place during installation and maintenance, and for enhancing filtering.

Figure 6:
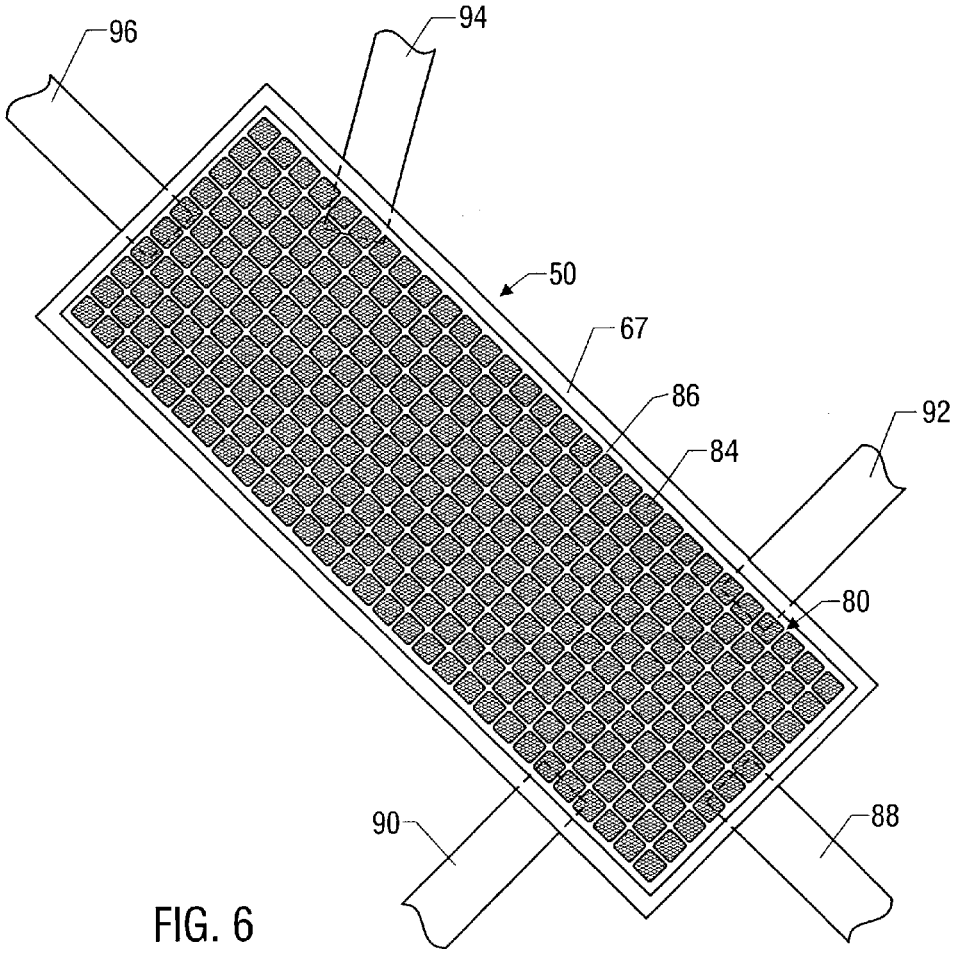
FIG. 6 is a plan view of the drain box of FIG. 5A, illustrating inlet and outlet pipes.

With reference to FIG. 6, the grate or grid 86 fits on and is supported by the shelf 62 (not shown) around the container 50. The retaining rim 66 keeps the cover 80 in place on the container 50. The top outward edge 67 of the rim 66 extends preferably about ⅛" above the top surface of the cover 80, and extends around the periphery of rim 66 to enhance strength. A water outlet pipe 88 is connected to the container 50 in any suitable manner such as by friction or by glue. Inlet and outlet holes in the container 50 are preferably placed in the container 50 during installation at appropriate locations depending on the location, shape and depth of the drainage area. The holes can be made with a drill or saw or other suitable technique. Water inlet pipes 90, 92, 94, and 96 may also be connected to the container 50 to allow water to drain into the drainage box. Main inlet or trunk pipe 96 is preferably non-perforated in this arrangement. Perforated pipes 90 and 92 form a "smile" drain at the lower end of the bunker 51. Perforated drainage pipe branches 98, 100, and 102 may be located to communicate with the main inlet or trunk pipe 96 depending on the shape and elevation of the sand trap or other sports playing surface. Perforated lateral drain pipe 94 may enter the box 50 directly. Main pipe 96 may also include a covered access 104, preferably at its end remote from the container 50, to help in cleaning the piping system. The piping system preferably includes perforated pipe. Each end of the branches may also include a covered access to facilitate cleaning.

The perforated drain pipe can be 4 inch pipe with slits or holes of a size to minimize entry of sand or other solids through the slots or holes. Gravel, sand, and other filter aid material of a size to enhance filtering can be packed around the pipe to aid in keeping the sand or other solids from entering the pipe.

The support grid or grate is preferably a fiberglass structure which is usually available in 4'×8' panels from Fibergrate Composite Structures, Inc., under the tradename Corvex. It is a polyester grating having an ASTM rating of 25 or less. Many other structural materials may also be employed to make the grate. The mesh or screen forming the envelope, pillow, or sock is preferably a product called Phifer SunScreen, a woven fiberglass, but many other materials may be used. The bag, sock, or envelope may be made by folding the woven fiberglass in half and by sewing two of the open edges of the folded fiberglass into the form of a sock or pillow case preferably by using nylon upholstery thread, or by melting a thermoplastic or curing a thermosetting material such as epoxy to seal the open edges of the sock while leaving an open end for insertion of the grate into the sock. Many plastic materials may be employed to form the water permeable mesh, including plastic screen. Plastic and other materials may be used to form the grids, as long as the material is sufficiently strong, stable, and preferably resistant to rust.

The bucket or container is preferably molded using a heavy gauge thermoforming process. The original sheets are preferably polyethylene about 0.300 inch in thickness and black in color. Other suitable materials, preferably plastic or composite materials, may be chosen to make the drainage box in accordance with the invention.

Figure 7:
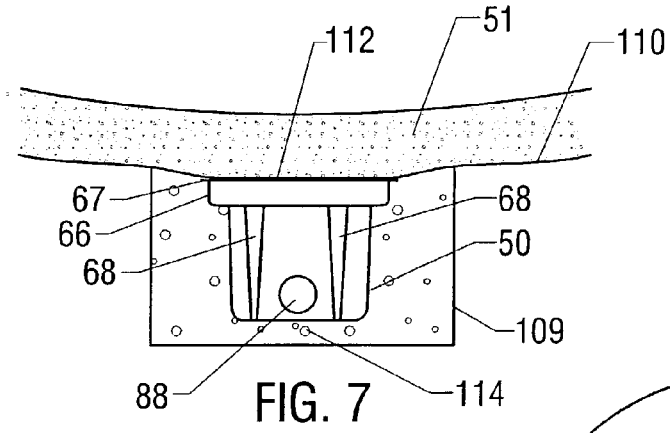
FIG. 7 is a sectional view of the drain box taken along line 7—7 in FIG. 8.
Figure 8:
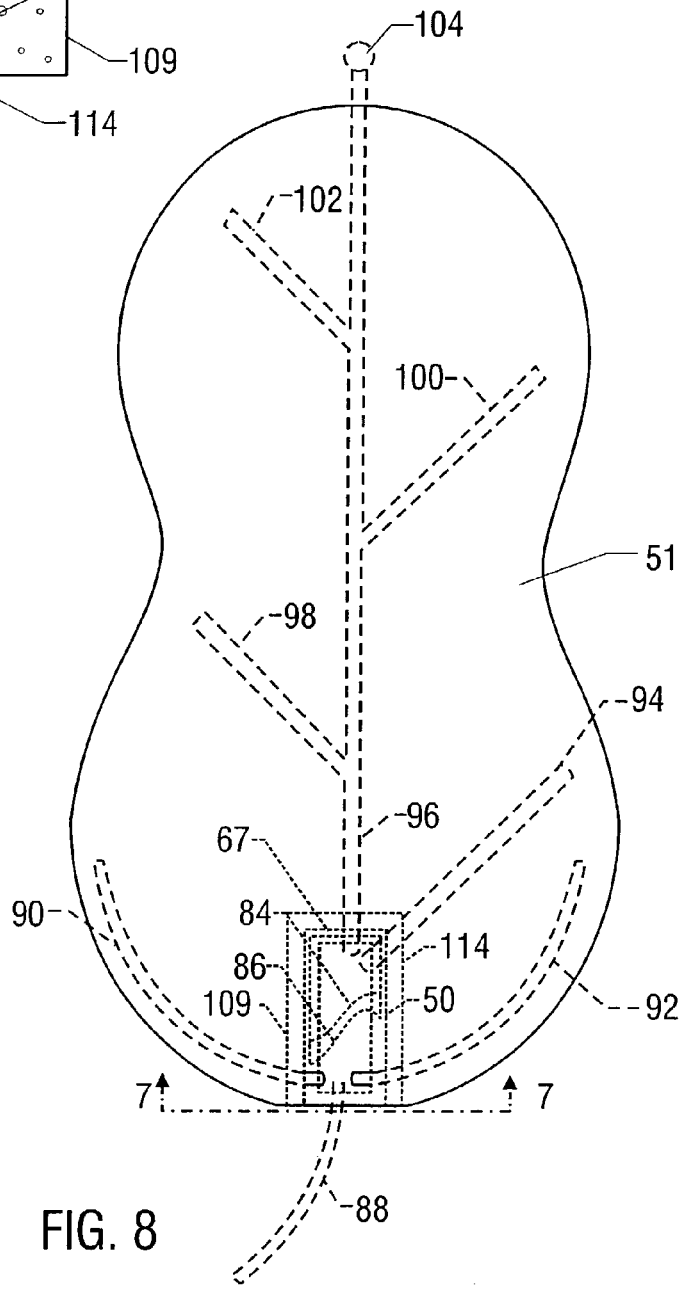
FIG. 8 is a plan view of a bunker illustrating the drain system with a drain box in place below the sand.

With reference to FIG. 7, the container 50 is preferably placed in a bunker 51 by digging or otherwise forming a hole or space 109 below the normal subgrade or bottom 110 of the bunker 51. Hole 109 is shaped to accept the box 50 with the top 112 of grid 86 being located about 2 inches below the normal subgrade 110. A normal bunker has about 5 to 6 inches of compacted sand. The box 50 is preferably surrounded with a stabilizing material 114 to hold the box 50 in place and retain its shape. Stabilized material may be compacted clay, subgrade material, stabilized sand, or other stabilized material. Concrete or other retaining material can also be used, but the drainage box may need to be treated to allow its removal if necessary. Hole 109 may have about 2 inches of material 114 below the box 50 and about 6 to 8 inches around its sides, but other sizes may be employed as desired.

The above structures and systems for playing fields may also be used for landscaped areas. The drainage box may be located under the surface of the landscaped area a sufficient distance to maintain a desirable appearance and activity above such as maintenance equipment and people walking. The overlying landscape material preferably has sufficient water permeability to allow passage of water into the box.

Although the invention has been described in terms of certain preferred embodiments, it will be apparent to those of ordinary skill in the art that modifications and improvements can be made to the inventive concepts herein without departing from the scope of the invention and its equivalents. The embodiments shown are illustrative of the inventive concepts and should not be interpreted as limiting the scope of the invention.

What is claimed is:

1. A drainage box for location and use below the surface of a sports field or landscaped area, which drainage box comprises:

a) a container having a substantially solid bottom surface and having sides forming a substantially continuous perimeter, the container being removable from the ground and further having a top opening and having a size and shape which can be located below the playing surface a sufficient distance and is adapted to permit persons to play above the drainage box, the container being removable from the ground;

b) the container having at least one support surface associated with the top opening; and c) a water permeable cover over the top opening and supported by the support surface, the water permeable cover on the support surface comprising a support grate and a water permeable mesh over the support grate and a protective grate above the water permeable mesh, the cover having a strength which is adapted to permit persons to play above the landscape material on the drainage box but which resists entry of solids into the box;

d) the water permeable cover being removable from the top opening to allow cleaning of the container and then replaceable for relocation below the surface of the sports field or landscaped area and to permit play above the box without damage to the box;

e) the box having one or more locations in its sides or bottom which can be associated with an exit pipe for drainage of water from the box.

2. The box of claim 1 in which the sports field is a golf course bunker and the playing surface is sand.

3. The box of claim 1 in which the container has one or more ribs in at least one side which strengthen the container.

4. The box of claim 1 in which the container has an upwardly facing surface around its periphery to support the cover.

5. The box of claim 1 in which the container has an upwardly directed rim around its periphery to retain the cover on the container.

6. The box of claim 1 in which the container has one or more supports across its interior to support the cover.

7. The box of claim 1 in which the container has one or more ribs in at least one side which strengthen the container, the container has an upwardly facing surface around its periphery to support the cover, and the container has an upwardly directed rim to retain the cover on the container.

8. The box of claim 1 in which the water permeable mesh forms an envelope and the support grate fits inside the envelope.

9. The box of claim 8 in which the cover has a protective grate located over the envelope of water permeable mesh.

10. The box of claim 1 in which the water permeable cover includes an envelope made of a water permeable mesh having a mesh size which resists entry of solids of the size of sand into the box.

11. A method for draining water from a sports playing field, which method comprises:

(a) locating a drainage box under the playing field to accept drainage water a sufficient distance below the surface of the playing field to allow activity above the box, the box having a water permeable cover with playing material over the cover;

(b) connecting the drainage box to an outlet which directs water outside of the playing field area, and (c) cleaning the box by removing material overlying the cover, removing the cover, and removing solids collected within the box; and then replacing the cover and the overlying material to reform the playing field area.

12. The method of claim 11 in which the cover includes a water permeable envelope which contains a support grate.

13. The method of claim 11 in which the box includes a container having a support surface around its periphery and a cover supported on the support surface, the cover comprising a support grate, a water permeable mesh over the top of the support grate, and a protective grate on top of the mesh, the mesh having a mesh size which resists passage of particles of the playing field through the mesh.

14. The method of claim 13 in which the mesh is in the form of an envelope and the support grate fits inside the envelope, the lower layer of the mesh envelope resting on the support surface of the container.

15. The method of claim 13 in which the box is located below the surface of the playing field by forming a hole below the surface of the playing field to accept the box to a sufficient depth to allow play above.

16. The method of claim 15 in which stabilizing material is placed in the hole to support the box in the hole.

17. The method of claim 11 in which the sports playing field is a golf course bunker and the playing material is sand.

18. A drainage system for a sports playing field, the drainage system comprising a drainage box located below the playing surface of the playing field to accept drainage water, the box being located a sufficient distance below the surface of the playing field and adapted to permit persons to play above the box, the drainage box comprising a container having a substantially solid bottom surface and having sides forming a substantially continuous perimeter, the container being removable from the ground, and having a water permeable cover on the container for supporting playing material over the cover and weight and impacts by sports players; playing material on and supported by the cover, the playing material having sufficient water permeability to allow passage of water through the playing material into the box; a drain outlet associated with the box to direct water from the box and the playing field; and a water collection system associated with the box to direct water from the playing field into the box;

the cover of the box being openable to allow cleaning of the box and being replaceable to allow reforming of the playing surface of the playing field without damage to the box.

19. The system of claim 18 in which the sports playing field is a golf course bunker and the playing material is sand.

20. The system of claim 18 in which the water collection system comprises perforated pipe having perforations of a size which resist passage of particles of playing material into the pipe.

21. A drainage system for a landscaped area, the drainage system comprising a drainage box located below the surface of the landscaped area to accept drainage water, the box being located a sufficient distance below the surface of the landscaped area and adapted to permit persons to engage in activity above the box, the drainage box comprising a container having a substantially solid bottom surface and having sides forming a substantially continuous perimeter, the container being removable from the ground, and having a water permeable cover on the container for supporting landscape material over the cover and weight and activity above the landscape material; landscape material on and supported by the cover, the landscape material having sufficient water permeability to allow passage of water through the landscape material into the box; a drain outlet associated with the box to direct water from the box and the landscape area; and a water collection system associated with the box to direct water from the landscape area into the box;

the cover of the box being openable to allow cleaning of the box and being replaceable to allow reforming of the surface of the landscaped area without damage to the box.

22. The system of claim 21 in which the water permeable cover comprises a support grate and a water permeable mesh supported on the support grate, the mesh having a mesh size which resists passage of particles of landscape material through the mesh but allows passage of water.

23. The system of claim 21 in which the water collection system comprises perforated pipe having perforations of a size which resist passage of particles of landscape material into the pipe.

* * * * *